US006675780B1

(12) United States Patent
Wendels et al.

(10) Patent No.: US 6,675,780 B1
(45) Date of Patent: Jan. 13, 2004

(54) FUEL SAVING AND POLLUTION EMISSION REDUCTION SYSTEM FOR INTERNAL COMBUSTION ENGINES

(76) Inventors: Antonius G. Wendels, 2150 N. Beachwood Dr., #10, Los Angeles, CA (US) 90068; John W. Frencher, 1811 Tamarind St., Hollywood, CA (US) 90028

( * ) Notice: Subject to any disclaimer, the term of this patent is extended or adjusted under 35 U.S.C. 154(b) by 0 days.

(21) Appl. No.: 10/253,009

(22) Filed: Sep. 24, 2002

(51) Int. Cl.[7] ..... F02M 33/00
(52) U.S. Cl. ..... 123/536; 123/539
(58) Field of Search ..... 123/536, 537, 123/538, 539

(56) References Cited

U.S. PATENT DOCUMENTS 3,943,407 A * 3/1976 Bolasny ..... 123/536
4,519,357 A * 5/1985 McAllister ..... 123/539
5,010,869 A * 4/1991 Lee ..... 123/539
6,176,977 B1 * 1/2001 Taylor et al. ..... 123/539

* cited by examiner

*Primary Examiner*—Marguerite McMahon
(74) *Attorney, Agent, or Firm*—Albert D. Cota

(57) ABSTRACT

A fuel saving and pollution emission reduction system (10) that utilizes an air ionizer (58) that is easily attached inline between a vehicle air-intake hose (106) and a fuel injection throttle body (108) or a carburetor air-intake structure (110). The air ionizer, which functions with either gasoline or diesel fuel engines is operated by an electronic ionizer control unit (12). The unit (12) is located within the confines of the vehicle's engine compartment and is operated by a 12-volt d-c power source (104) derived from the vehicle's battery (102). When air from the vehicle air-intake hose (106) Passes through the air ionizer (12) the air is ionized and is mixed with the non-ionized air to produce an oxygen-enriched fuel-air mixture. The oxygen-enriched mixture allows a fuel saving and produces a cleaner burning fuel which reduces hydro-carbon exhaust emission levels.

8 Claims, 5 Drawing Sheets

FUEL SAVING AND POLLUTION EMISSION REDUCTION SYSTEM FOR INTERNAL COMBUSTION ENGINES

TECHNICAL FIELD

The invention generally pertains to vehicle fuel saving devices and more particularly to a fuel saving and pollution emission reduction system that functions by mixing ionized air with non-ionized air to produce an optimized fuel-air mixture.

BACKGROUND ART

For many people throughout the world the preferred type of personal transportation is a vehicle such as car or truck. Vehicles using internal combustion engines are also used for much of the world's commercial transport needs. After the first internal combustion engines were invented, the development of the engines continued, which eventually led to the development of today's modern engines.

During the late 1960's and into the 1970's many countries where automobiles were utilized in substantial numbers began to check on the amount of damage that was being caused as a result of burning fossil fuels in engines. Led by the United States, it was determined that due to large amount of toxic substances that were being expelled into the earth's atmosphere from engine exhaust, a major problem existed. By the time of the tests many engines had developed to the point where they were using multi-cylinder, large displacement designs to provide higher power. Unfortunately, the higher power came at the cost of far greater exhaust emissions. The solution was to require vehicles to use catalytic converters and to regulate the amount of emissions that were allowed. While these solutions did help lower the amount of emissions, most vehicles also lost much of their efficiency, with higher miles per gallon (MPG) of gasoline rates and less power.

Many companies and individuals sought a solution to remedy the "problems" associated with maintaining lower emissions. Although some of the ideas did manage to provide a means by which a vehicle could operate with high gas mileage and good performance along with low emissions, most of the ideas were too expensive and/or complex to be adapted into general use by automakers. As time has progressed, there have been continued efforts to address this problem, which still could use an effective solution even though many vehicles now possess substantial power (and can be further improved by individuals who desire even more power).

The problem still exists that typical internal combustion engines use gasoline as fuel. Since gasoline is derived from a natural resource, the world's supply is limited and eventually will run out. Also, the price of gasoline continues to rise. As a result, there is a substantial effort to develop engines that will provide greater mileage and allow the engines to go further on less fuel, thus conserving fuel and saving the consumer money.

One solution that offers potential utilizes ionized air that is mixed with the regular air within the engine. Internal combustion engines utilize a mixture of air and gasoline to produce an explosion (the combustion) which in turn causes the engine's internal mechanism to operate. By using the mixture of ionized air with regular air, higher efficiency along with better mileage results.

A search of the prior art did not disclose any patents that read directly on the claims of the instant invention, however the following U.S. patents are considered related:

| U.S. PAT. NO. | INVENTOR | ISSUED |
|---|---|---|
| 5,664,546 | De LaTorre Barreiro | 9 Sep. 1997 |
| 4,212,274 | Quick | 15 Jul. 1980 |
| 4,105,010 | Rand, Jr. | 8 Aug. 1978 |

The U.S. Pat. No. 5,664,546 patent discloses a fuel economizer having a non-magnetic body surrounding a fuel feed pipe and fitted with internal magnets. The fuel economizer includes two half casings of non-magnetic material joined to each other by a clamp that keep them attached to the pipe through which the fuel runs. A magnetic field perpendicular to the pipe is generated by a first magnet and a second magnet. A third magnet has a perpendicular field with its poles inverted with respect to the first magnet. The magnets allow a magnetic flow to be concentrated toward the inside of the conduit to prevent exit of the flow towards the outside of the fuel economizer.

The U.S. Pat. No. 4,212,274 patent discloses a carbonation enhancer having a cylindrical shell that is closed at one end by an involute wall spaced from the inner end of a withdrawal tube. The output stream of a conventional carburetor is directed tangentially into space between the shells and caused to move in a spiral path toward the involute closure wall by a spiral vane in the space. Upon reaching the involute wall, the stream moves radially into the inner end of the withdrawal tube and travels axially in a direction opposite that of the spiral path, with the stream exiting the tube to enter the inlet manifold of the engine. Waste engine heat is applied to the exterior of the cylindrical shell in an amount sufficient to vaporize liquid fuel droplets centrifuged against the stream as the latter traverses the spiral path portion of its travel from the carburetor to the intake manifold.

The U.S. Pat. No. 4,105,010 patent discloses a fuel saving apparatus for controlling the supply of fuel to one or more selected cylinder of a multi-cylinder internal combustion engine. The apparatus comprises a remotely and independently controlled fuel saving valve operably positioned to provide selective communication between the cylinder clearance volume and a reservoir volume disposed externally thereof. The valve is closed for normal, full power engine operation, and is opened for predetermined low engine power demand periods. The opening of the valve reduces cylinder intake vacuum and resultant air-fuel influx as to render temporarily ineffective the cylinder, thereby reducing engine fuel consumption.

For background purposes and as indicative of the art to which the invention is related reference may be made to the remaining cited patents.

| U.S. PAT. NO. | INVENTOR | ISSUED |
|---|---|---|
| 5,231,963 | Perkins | 3 Aug. 1993 |
| 4,437,698 | Tantalo | 20 Mar. 1984 |
| 4,130,099 | Ferguson | 19 Dec. 1978 |
| 4,018,204 | Rand, Jr. | 19 Apr. 1977 |

DISCLOSURE OF THE INVENTION

The fuel saving and pollution emission reduction system functions in combination with a vehicle having a gasoline or diesel powered internal combustion engine that is operated with a vehicle battery, a vehicle air-intake hose and a fuel injection throttle body or a carburetor air-intake structure.

In its basic design, the system is comprised of an air ionizer having a non-ionized air input port and an do ionized air output port. The input port is connected to the vehicle's air-intake hose, and the output port is connected to the full-injection throttle body or the carburetor air-intake structure. The air ionizer is connected to and is controlled by an electronic ionizer control unit that is is applied power via a power cable that is connected to a vehicle 12-volt d-c power source. When the ionized air from the air ionizer is mixed with the non-ionized air entering through the air intake hose, an oxygen-enriched fuel-air mixture is produced that provides a fuel saving and reduces hydro-carbon vehicle exhaust emissions. The air ionizer can consist of a high-voltage corona discharge device or an ultraviolet lamp device.

The corona discharge device consists of a high-Q insulator such as glass, that is sandwiched between an outer metal screen and an inner metal screen. The two screens are respectfully attached to a secondary winding of a transformer that produces a voltage ranging from 4000 volts a-c to 7000 volts a-c. When air passes through the two energized screens the air becomes ionized The ultraviolet lamp device operates with a lamp having a wavelength from 245 nm to 260 nm. The lamp has a pair of electrodes that are connected to an inverter that steps up the 12-volt d-c voltage to a 120-volt a-c voltage which is sufficient to illuminate the lamp. When air passes over the illuminated lamp the air is ionized.

In view of the above disclosure, the primary object of the invention is to produce an oxygen enriched fuel-air mixture. When the mixture is applied to an internal combustion engine a fuel saving and a reduction in pollution emission is achieved.

In addition to the primary object of the invention it is also an object of the invention to produce a system that:

- is designed with high-reliability components to produce a system having a high mean-time-between failure (MTBF),
- is easily installed and maintained,
- can be used with both a carburetor engine or a fuel-injection engine,
- is dimensioned to allow the system to be installed in a minimum space,
- functions with either a gasoline or diesel internal combustion engine, and
- is cost effective from both a manufacturer's and consumer's point of point.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
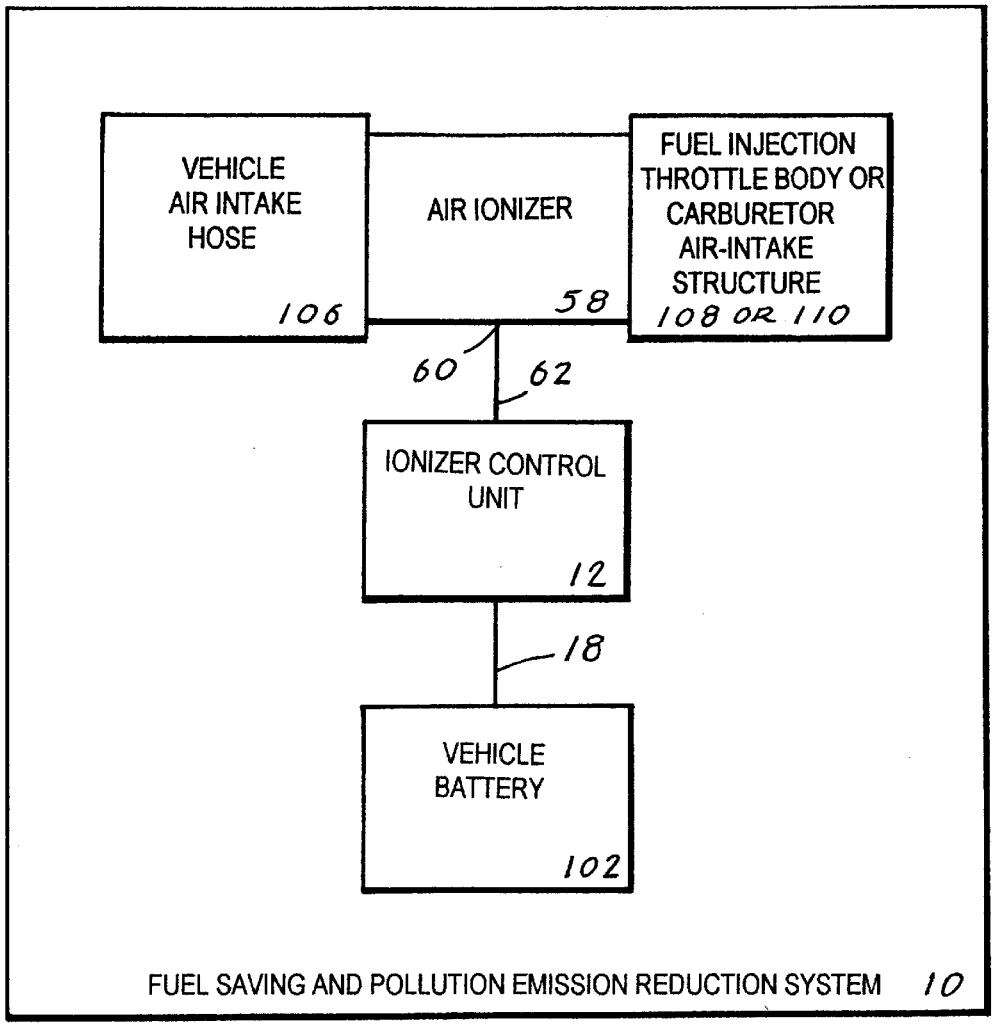
FIG. 1 is a block diagram of a basic design for a fuel saving and pollution emission reduction system.
Figure 2:
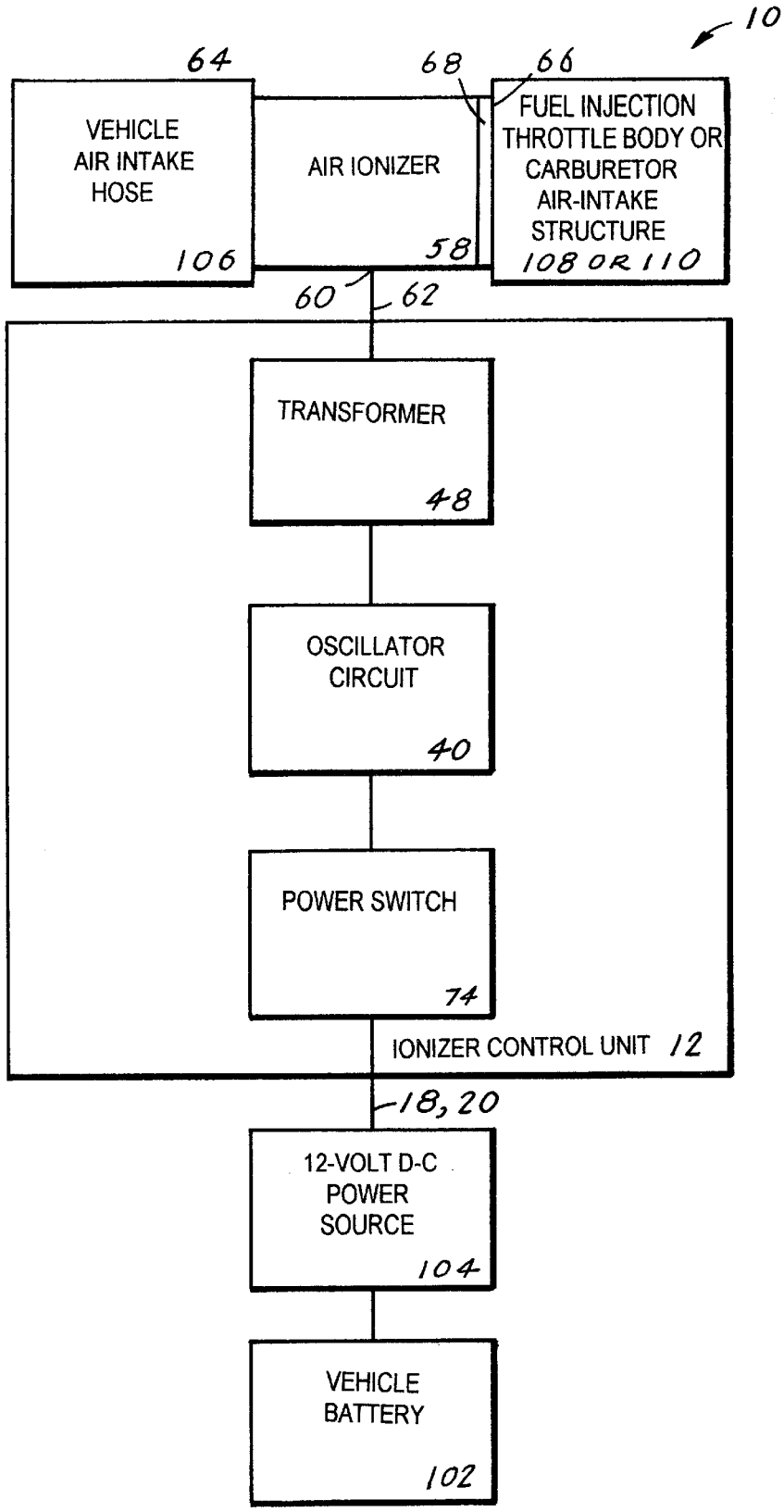
FIG. 2 is a block diagram of an advanced design for a fuel saving and pollution emission reduction system.
Figure 3:
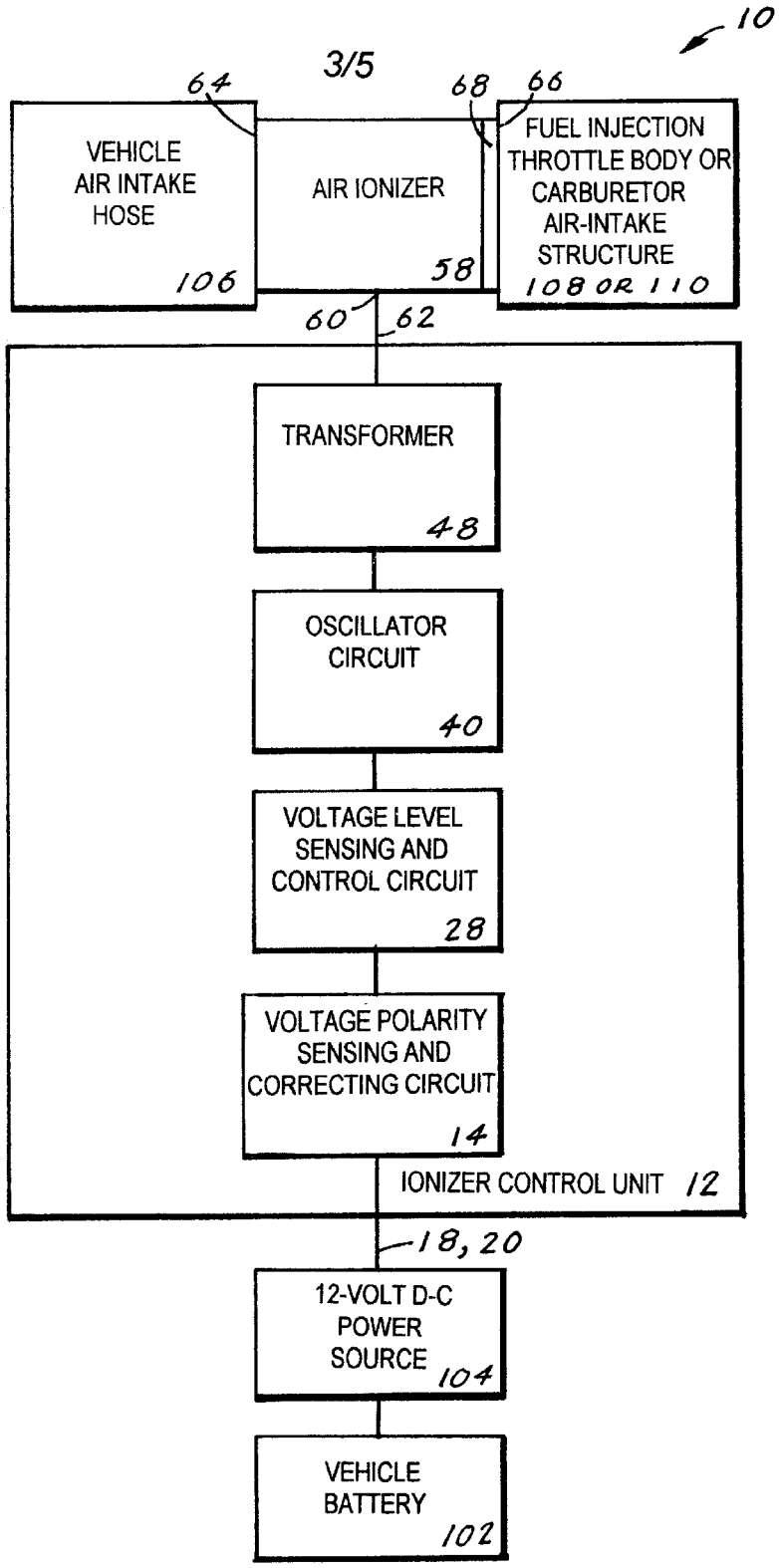
FIG. 3 is a block diagram of a fully-implemented advanced design for a fuel saving and pollution emission reduction system.

The best mode for carrying out the fuel saving and pollution emission reduction system 10 is presented in terms of a basic system 10, as shown in FIG. 1, a simplified system 10, as shown in FIG. 2, and in a fully-implemented system 10, as shown in FIG. 3. The fully-implement system 10 is comprised of the following major elements: an ionizer control unit 12, a voltage polarity sensing and correcting circuit 14, a power cable assembly 18, a voltage level sensing and control circuit 28, an oscillator circuit 40, a transformer 48, an air ionizer 58, and a control cable assembly 62.

All three systems 10 function in combination with a vehicle having a gasoline or diesel internal combustion engine that operates with a vehicle battery 102, a 12-volt d-c power source 104, a vehicle air-intake hose 106, and a fuel-injection throttle body 108 or a carburetor air-intake structure 110.

The basic system, as shown in FIG. 1, utilizes an air ionizer 58 that is operated by an ionizer control unit 12 that is energized by the vehicle's battery 102. The simplified design, as shown in FIG. 2, utilizes an ionizer control circuit 12 that does not use the polarity sensing and correcting circuit 14 and the voltage level sensing and control circuit 28. In lieu of these circuits the simplified design includes an input circuit consisting of a manually-operated power switch 74 that applies the 12-volt d-c voltage from the 12-volt d-c Power source 104 directly to the oscillator circuit 40 via the power cable assembly 18. When using the simplified design it is necessary to observe the proper voltage polarity when connecting the ionizer control unit 12 to the 12-volt d-c power source 104. Additionally, the manually-operated power switch 74 must be turned off when the system 10 is not operating to prevent a power drain on the battery 102 when the vehicle's engine is turned off.

For purposes of brevity, the description that follows will be limited to the fully implemented design as shown in FIG. 3.

The voltage polarity sensing and correcting circuit 14 has an input 16 that is connected via the power cable assembly 18, which incorporates a fuse 20, to the 12-volt d-c power source 104 that is supplied the voltage from the vehicle's battery 102. The d-c power source 104 can consist of any accessible 12-volt d-c located within the confines of the vehicle and in particular within the vehicle's engine compartment. The circuit 14 has means for automatically sensing and selecting the correct voltage polarity from the vehicle's battery 102 required to operate the system 10. The output of the circuit 14 is a 12-volt d-c signal corrected for voltage polarity.

Figure 4:
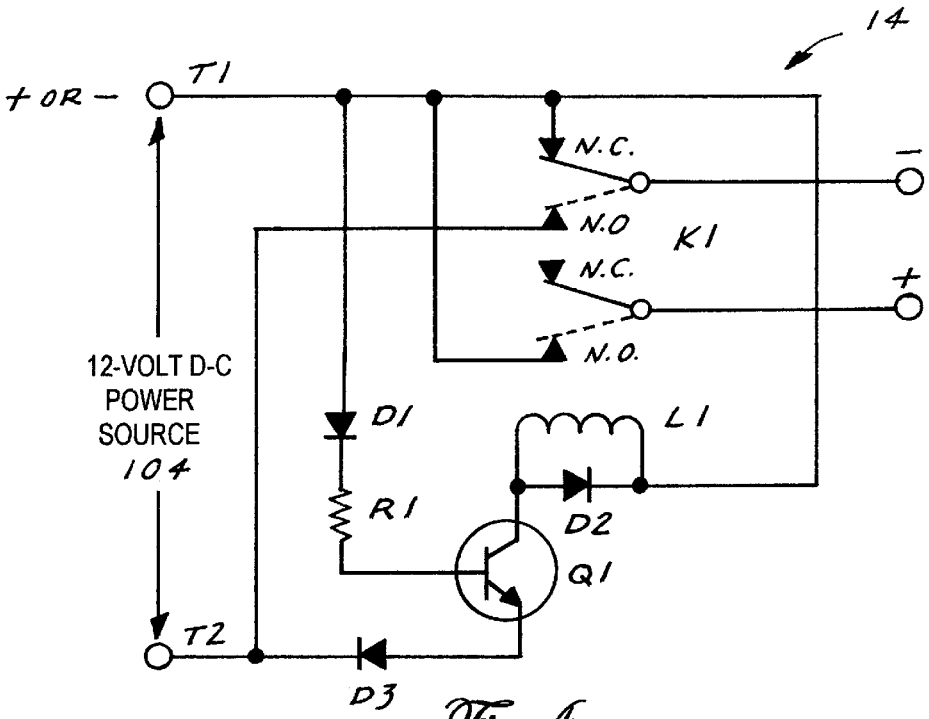
FIG. 4 is a schematic diagram of a typical voltage polarity sensing and correcting circuit.

A typical implementation of a voltage polarity sensing and correcting circuit 14, as shown in FIG. 4, consists of a transistor G1, diodes D1, D2 and D3, a resistor R1 and a DPDT relay K1.

When the voltage polarity applied at terminal T1 of the circuit 14 from the 12-volt d-c power source 22 is positive (+), the transistor Q1 is energized by forward biasing the base of the transistor by way of diodes D1 and resistor R1. The energized transistor Q1 activates the coil L1 of the relay K1 which switches the power from the normally closed (NC) contact of the relay K1 to the normally open (NO) contact of relay K1 which then allows the battery polarity to be corrected. If T1 is negative (–) diode D3 blocks current flow and no corrective action is required.

The 12-volt d-c signal from the circuit 14 is applied to the input of the voltage level sensing and control circuit 28. The circuit 28 has means for illuminating a red LED 32 or a green LED 34. The red LED 32 illuminates when the system 10 is in a standby mode and the green LED illuminates when the vehicle engine is running and the system 10 is in an operational mode. In the operational mode the output of the circuit 28 is a 12-volt d-c signal.

Figure 5:
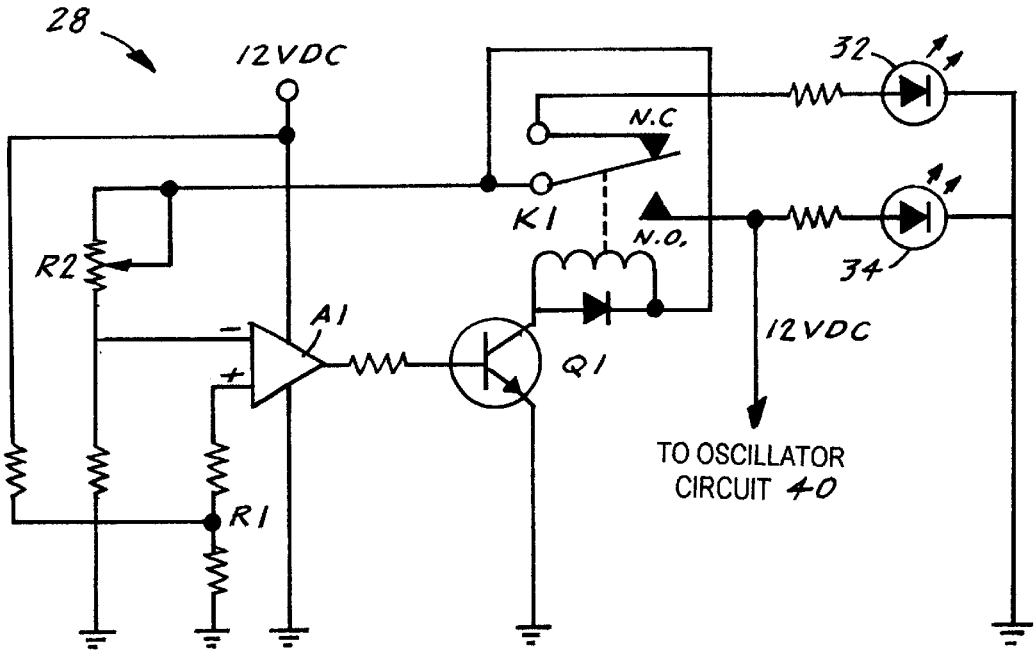
FIG. 5 is a schematic diagram of a typical voltage level sensing and control circuit.
Figure 6:
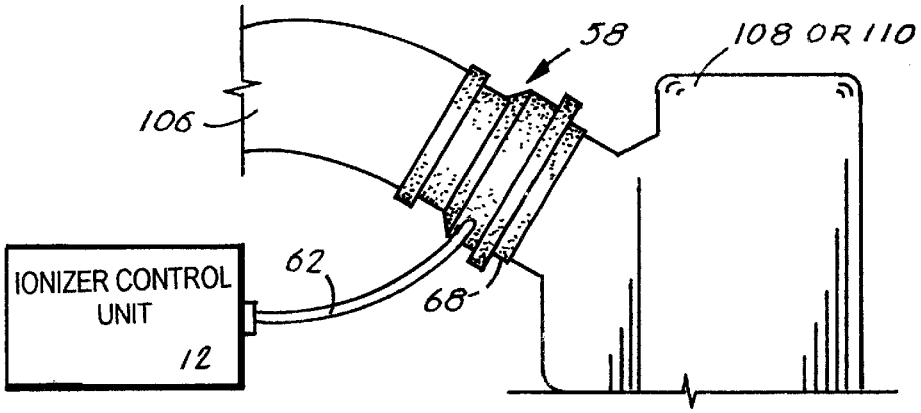
FIG. 6 is an illustration showing an air ionizer attached between a vehicle air-intake hose and a fuel injection throttle body or a carburetor air-intake structure.

A typical implementation of a voltage level sensing and control circuit 28, as shown in FIG. 5, consists of a resistor network R1, a potentiometer R2, an inverter A1, a transistor Q1, and a single-pole, double throw relay K1.

The circuit 28 basically consists of a comparator circuit that has a non-inverting input level sot to 5.6 volts by potentiometer R2. When the vehicle engine 90 is not running the input level is divided by the resistor network R1 and applied to the positive (+) inverting input of the inverter A1. The divided input is equal to or less than the voltage of the negative (–) non-inverting input which causes the output of the inverter A1 to sink current and cut off the transistor Q1. Under this condition the red LED 32 will illuminate, thus indicating that the system 10 is in the standby mode.

When the vehicle's engine is started, the input voltage from the vehicle's battery 102 of 11.6 to 12.6 volts d-c increases to 13.8 to 15 volts d-c. The amount of increase is dependent upon the state of the battery 102 and the vehicle's alternator. The increase in voltage causes the inverting input to rise above the non-inverter input and switch from current sinking to current sending. The change in voltage turns on the transistor Q1 and switches the relay K1 from its normally closed contact to the normally open contact. Under this condition the standby red LED 32 is turned off and the green LED 34 turns on, thereby indicating that the circuit 28 is operational and supplying an output of 12-volt d-c to the oscillator circuit 40.

12-volt d-c from the circuit 28 is applied to the oscillator circuit 40 which is designed to oscillate and produce a 12-volt high frequency output signal ranging from 15 KHZ to 45 KHZ. The output from the oscillator circuit is applied to the primary winding 50 of the transformer 48 which also has a secondary winding 52. The transformer 48 has a primary-to-secondary turn ratio of 1:1500 which allows the secondary winding 52 to produce an output signal ranging from 4000 volts a-c to 7000 volts a-c.

Figure 7:
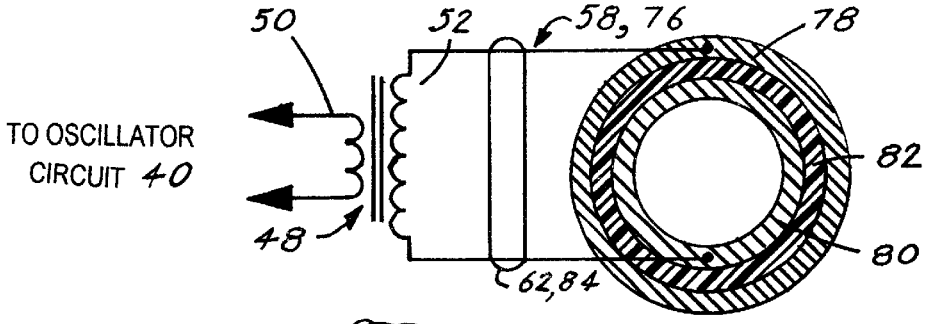
FIG. 7 is a block/sectional diagram of an air ionizer consisting of a high-voltage corona discharge device.

The output from the secondary winding 52 of the transformer 48, as shown in FIGS. 2, 3 and 7, is applied to the electrical input 60 of the air ionizer 58 through the control cable assembly 62. The air ionizer, as shown in FIGS. 1, 2, 3, 6, 7 and 8, also has an air input 64 connected to the vehicle's air intake hose 106, and an air outlet 66 that routes the ionized air into the fuel injection throttle body 108 (as used for fuel-injection engines) or the carburetor air-intake structure 110 (as used for carburetor engines). The ionized air is preferably applied through a static air-mixing structure 68, as shown in FIGS. 2 and 3, that is comprised of a housing 70, as shown in FIG. 9. The housing 70 has at least two staggered mixing blades 72, with each blade having a pitch that is equal to or less than 15°.

The structure 68 functions as a support for the air ionizer 58 and is designed to route and blend the ionized air with the non-ionized air to produce an optimized fuel-air mixture before entering the fuel injection throttle body 108 or the carburetor air-intake structure 110.

Figure 8:
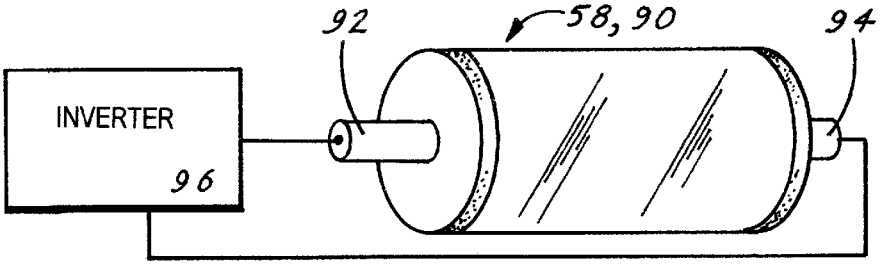
FIG. 8 is a diagram of an air ionizer consisting of an ultraviolet lamp device.
Figure 9:
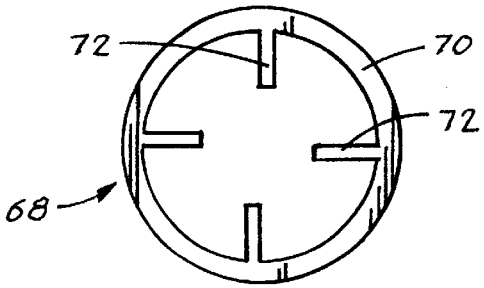
FIG. 9 is an elevational view of a static air mixing structure.

The air ionizer 58 is disclosed in two design configurations, a high-voltage corona discharge device 76, as shown in FIG. 7 and an ultraviolet lamp device 90, as shown in FIG. 8.

The high-voltage corona discharge device 76, as shown in FIG. 7, is comprised of a structure consisting of an outer metal screen 78, an inner metal screen 80 and a high-Q insulator 82 that is placed between the outer and inner metal screens 78,80 to prevent arcing between the two screens. The screens are preferably made of a 30-gauge metal wire mesh and the la insulator is preferably made of glass or the like. The device 76 is energized by connecting the secondary winding 52 of the transformer 48 by means of the control cable assembly 62, that preferably consists of a coaxial or twin-lead cable, to the outer and inner metal screens 78, 80. The device 76 typically has a length of 2 to 3 inches (5.08 to 7.62 cm), a diameter ranging between 1 and 1.2 inches (2.54 to 3.05 cm) and an air-passage opening of 0.25 inches (0.635 cm).

The air ionizer 58 consisting of the ultraviolet lamp 90 is shown in FIG. 8. The ultraviolet lamp 90 has a first electrode 92 and a second electrode 94. The two electrodes are connected to an inverter 96 that steps up the input of 12-volt d-c to an output of 120-volts a-c. When the ultraviolet lamp 90 illuminates, the air passing over the lamp will be ionized.

While the invention has been described in complete detail and pictorially shown in the accompanying drawings it is not to be limited to such details, since many changes and modifications may be made in the invention without departing from the spirit and scope thereof. Hence, it is described to cover any and all modifications and forms which may come within the language and scope of the appended claims.

What is claimed is:

1. A fuel saving and pollution emission reduction system that functions in combination with a vehicle having a gasoline or diesel powered internal-combustion engine that functions with a vehicle battery, a vehicle air-intake hose and a fuel injection throttle body or a carburetor air-intake structure, said system comprising:

a) an ionizer control unit comprising:

(1) a voltage polarity sensing and correcting circuit having an input connected via a power cable to a 12-volt d-c power source located within the vehicle and connected to the + and – terminals of the vehicle battery, wherein said circuit having means for automatically sensing and selecting the voltage polarity from the vehicle battery required to operate said system, wherein the output of said circuit is a 12-volt d-c signal corrected for voltage polarity, (2) a voltage level sensing and control circuit having an input connected to the output of said voltage polarity sensing and correcting circuit, wherein said voltage level sensing and control circuit has means for illuminating a red LED when said system is in a standby mode or means for illuminating a green LED when the vehicle engine is running and said system is in an operational mode, wherein in the operational mode the output of said circuit is a 12-volt d-c signal, (3) a high-frequency oscillator circuit having an input supplied from the output of said voltage level sensor and control circuit, wherein said oscillator having means for producing a high-frequency output signal, (4) a transformer having a primary winding and a secondary winding, wherein the primary winding is connected to the output of said high-frequency oscillator, and the secondary winding produces a high-voltage a-c signal and, b) an air ionizer having an electrical input supplied from the secondary winding of said transformer via a control cable assembly, an air input connected to the vehicle air intake hose, and an air outlet that routes the ionized air into the fuel injection throttle body or the carburetor air-intake structure of the vehicle engine via a static air mixing structure.

2. The system as specified in claim 1 wherein the power cable includes an inline fuse.

3. The system as specified in claim 1 wherein the high-frequency output signal from said oscillator ranges from 15 KHZ to 45 KHz.

4. The system as specified in claim 1 wherein said transformer has a primary to secondary turn ratio of 1:1500, wherein the secondary winding of said transformer produces a voltage ranging from 4000 volts a-c to 7000 volts a-c.

5. The system as specified in claim 1 wherein said air ionizer consists of a high-voltage corona discharge device comprising:

a) an outer metal screen, b) an inner metal screen, and c) a high-Q insulator located between the outer and the inner metal screens, wherein the output from the secondary winding of said transformer is applied across the outer metal screen and the inner metal screen.

6. The system as specified in claim 5 wherein the high-Q insulator is comprised of glass.

7. The system as specified in claim 1 wherein said air ionizer is comprised of an ultraviolet lamp device that when illuminated, any air passing over the lamp is ionized.

8. The system as specified in claim 1 wherein said static air mixing structure is comprised of a housing having at least two mixing blades with each blade having a pitch equal to or less than 15°.

* * * * *